United States Patent [19]

MacDonald

[11] Patent Number: 4,891,956

[45] Date of Patent: Jan. 9, 1990

[54] INDICIA DEVICE

[76] Inventor: Sumner B. MacDonald, 39 Sea Breeze La., Bristol, R.I. 02809

[21] Appl. No.: 286,308

[22] Filed: Dec. 19, 1988

[51] Int. Cl.[4] ..... A44C 25/00

[52] U.S. Cl. ..... 63/3; 63/2; 63/23

[58] Field of Search ..... 40/1.5, 1.6, 27.5; 63/23.3, 4, 2, 21, 30, 29.1; 24/113 R, 113 MP

[56] References Cited

U.S. PATENT DOCUMENTS

| | | | |
|---|---|---|---|
| 733,029 | 7/1903 | Gosling | 63/29.1 |
| 2,402,956 | 7/1946 | Fyfe | 63/29.1 X |
| 2,931,196 | 4/1960 | Liftman | 63/29.1 X |
| 3,557,478 | 1/1971 | Sitzberger | 40/1.5 |
| 4,399,910 | 8/1983 | Gutentag | 40/27.5 X |

FOREIGN PATENT DOCUMENTS

| | | | |
|---|---|---|---|
| 6050 | 10/1903 | Denmark | 24/113 MP |
| 546791 | 11/1922 | France | 63/23 |

*Primary Examiner*—James R. Brittain

[57] ABSTRACT

A jewelry charm including an outer portion having a rolled-over lip, a spring member resiliently mating with the rolled-over lip and an insert configured to fit within the outer portion, where the insert is placed within the outer portion and the spring is mated with the rolled-over lip to retain the insert in the outer portion.

8 Claims, 2 Drawing Sheets

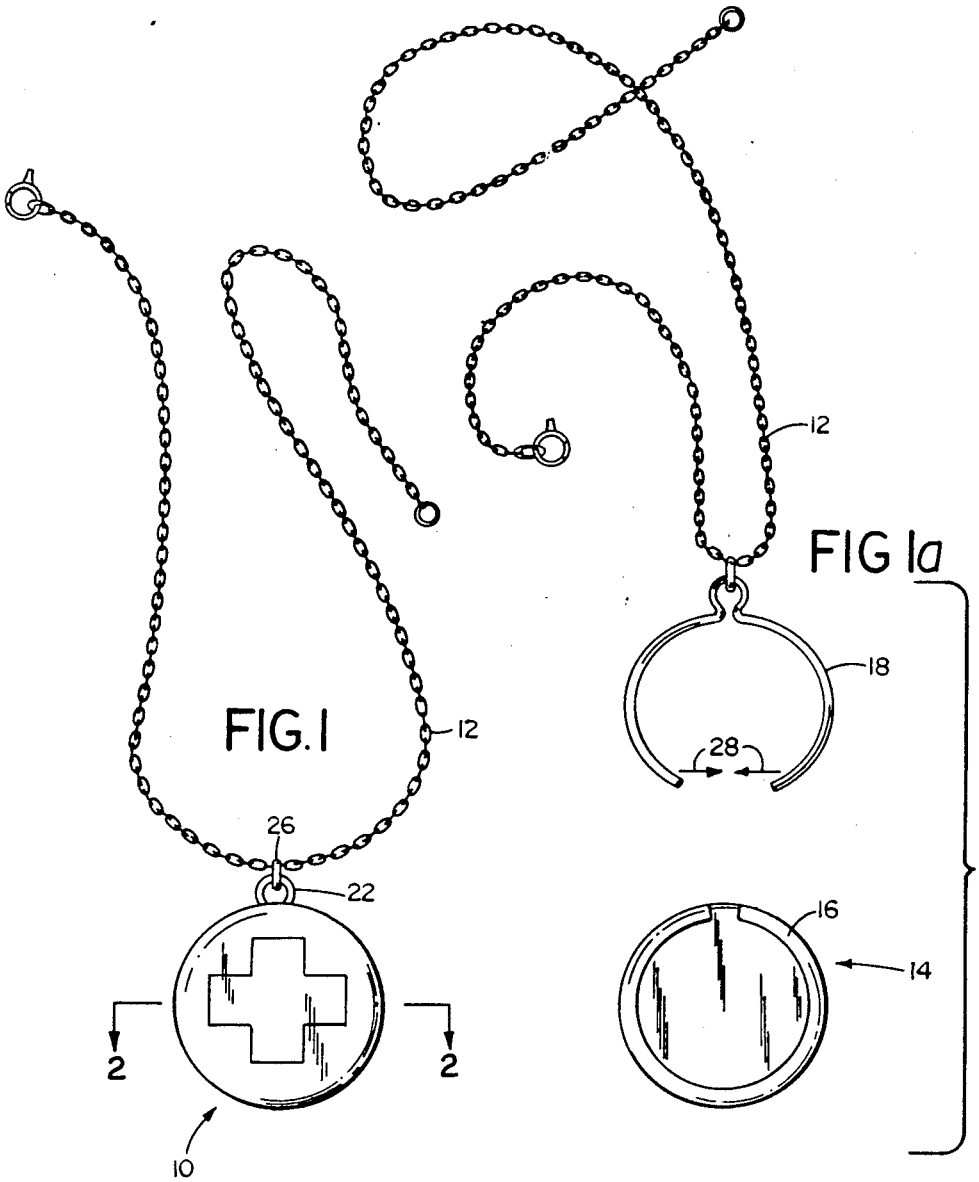
FIG. 1
FIG 1a
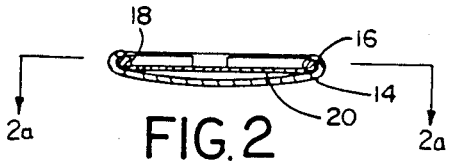
FIG. 2
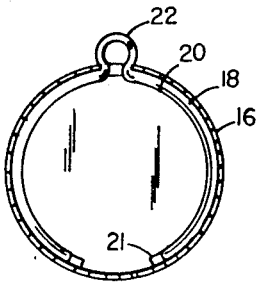
FIG. 2a

INDICIA DEVICE

BACKGROUND OF THE INVENTION

The present invention relates to jewelry charms.

It is known to use a jewelry charm as a pendant or part of a bracelet. It is also known to use such a charm to set forth information about the wearer. This information may include the wearer's address or medical information.

SUMMARY OF THE INVENTION

It has been discovered that by providing a jewelry charm with an outer portion having a rolled-over lip, a spring member mating with the rolled-over lip and an insert configured to fit within the outer portion, the charm may easily and changeably set forth information. In preferred embodiments the charm may include a spring having a projection to which a flexible hanging member may be connected, the charm may be a pendant, and the charm may be part of a bracelet.

DESCRIPTION OF THE PREFERRED EMBODIMENT

The drawings are first briefly described.

Drawings

FIG. 1 is a perspective view of a charm according to the invention.

Figure 1B:
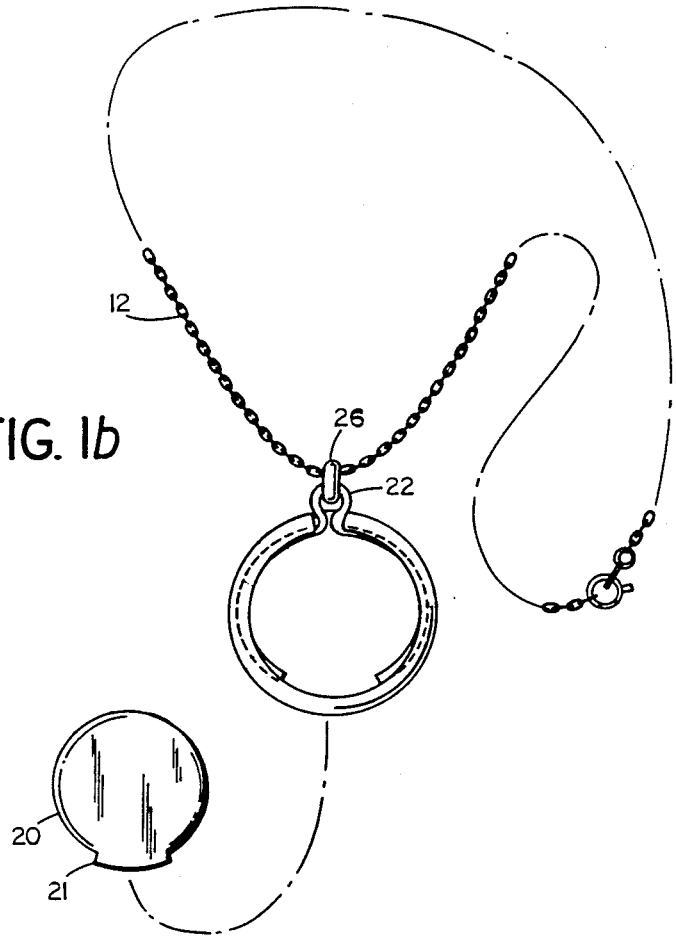

FIGS. 1*a* and 1*b* are exploded views of the FIG. 1 charm.

FIG. 2 is a cross-sectional view along lines 2—2 of the FIG. 1 charm.

FIG. 2*a* is a cross-sectional view along lines 2*a*—2*a* of the FIG. 2 charm.

Figure 3:
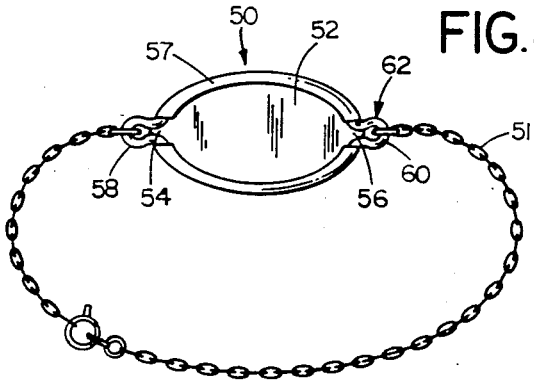

FIG. 3 is a perspective view of an alternate charm according to the invention.

Structure

Referring to FIGS. 1, 1*a*, 1*b*, 2 and 2*a*, charm 10 is a pendant which hangs from flexible hanging member 12, which is, e.g., a chain or a string. Charm 10 includes outer portion 14 (made of, e.g., gold, silver, stainless steel or plastic), which has rolled-over lip 16 around most of the circumference of outer portion 14, spring member 18, which resiliently mates with rolled over lip 16, and insert 20, which fits within outer portion 14. Insert 20 includes protuberance 21 which corresponds to the gap between the ends of spring member 18.

Spring member 18 includes projection 22 which axially extends beyond outer portion 14 through gap 24. Flexible holding member 12 attaches to protrusion 22 with ring 26.

Operation

Referring to FIGS. 1–2, spring member 18 is compressed (arrows 28) to remove it from outer portion 14. Insert 20, having, e.g., medical information engraved on it, is then inserted into outer portion 14. Spring member 18 is again compressed so that its radius is less than that of lip 16 and then inserted past lip 16 of outer portion 14. Spring member 18 is then released, thereby securely, but removably, attaching insert 20 to outer portion 14.

When spring member 18 is released, the ends of spring member 18 abut protuberance 21 of insert 20 and thus act as circumferential stops for insert 20.

Because insert 20 may be easily attached to outer portion 14, charm 10 may be given to a donee as a gift by a donor who does not know the donee's specific medical information. The donee may have his or her specific information engraved on the insert and then simply attach the insert to the outer portion to provide a charm which displays the donee's medical information.

Other Embodiments

Other embodiments are within the following claims. E.g., referring to FIG. 3, charm 50 is attached to flexible hanging member 51; the combination of charm 50 and flexible hanging member 51 provides a bracelet. In this embodiment, outer portion 52 is oval shaped and has two gaps 54, 56 in lip 57 through which protrusions 58, 60 of spring member 62 extend. Flexible hanging member 51 attaches to protrusions 58, 60.

What is claimed is:

1. A jewelry charm comprising
an outer portion,
said outer portion including a rolled-over lip,
a spring member,
said spring member resiliently mating with said rolled-over lip, and
an insert,
said insert being configured to fit within said outer portion,
said insert including an integral protuberance,
said spring member including ends, said ends defining a gap, said protuberance extending between said ends into said gap, said ends thereby acting as circumferential stops for said insert,
wherein said insert is placed within said outer portion and said spring member is mated with said roller-over lip to removably retain said insert in said outer portion.

2. The jewelry charm of claim 1 further comprising
a flexible hanging member, and wherein
said spring includes a projection,
said flexible hanging member supporting said spring member by said projection.

3. The jewelry charm of claim 2 wherein
said spring member includes a second projection, and
said flexible hanging member supports said spring member by both said projections.

4. The jewelry charm of claim 1 wherein said jewelry ornament is a pendant.

5. The jewelry charm of claim 1 wherein said jewelry ornament is part of a bracelet.

6. The jewelry charm of claim 1 wherein said outer portion is circular.

7. The jewelry charm of claim 1 wherein said outer portion is oval shaped.

8. The jewelry charm of claim 1 wherein
said spring member extends around a portion of said outer portion and said gap corresponds to a portion of said outer portion around which said spring member does not extend.

* * * * *